US006790100B2

(12) United States Patent
Nankou et al.

(10) Patent No.: US 6,790,100 B2
(45) Date of Patent: Sep. 14, 2004

(54) FEMALE TERMINAL FITTING

(75) Inventors: Yuuichi Nankou, Yokkaichi (JP); Yukihiro Fukatsu, Yokkaichi (JP); Hajime Kawase, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/405,260

(22) Filed: Apr. 1, 2003

(65) Prior Publication Data

US 2003/0190847 A1 Oct. 9, 2003

(30) Foreign Application Priority Data

Apr. 3, 2002 (JP) ..... 2002-101042

(51) Int. Cl.[7] ..... H01R 11/22
(52) U.S. Cl. ..... 439/851
(58) Field of Search ..... 439/851, 852, 439/856, 858

(56) References Cited

U.S. PATENT DOCUMENTS 5,235,743 A 8/1993 Endo et al.
5,269,712 A * 12/1993 Denlinger et al. ..... 439/845
5,443,592 A * 8/1995 Ittah et al. ..... 439/851
6,293,833 B1 * 9/2001 Kamath ..... 439/851
2003/0032342 A1 * 2/2003 Shimizu

* cited by examiner

*Primary Examiner*—Tho D. Ta
*Assistant Examiner*—James R. Harvey
(74) *Attorney, Agent, or Firm*—Gerald E. Hespos; Anthony J. Caselia

(57) ABSTRACT

A female terminal fitting (10) has a tubular main body (11) with front and rear ends and a bottom wall (13). A fold (20) is folded back from the front end of the bottom wall (13) and a resilient contact piece (18) extends back from the fold (20) to face the bottom wall (13). A bulge (23) on the resilient contact piece (18) includes a contact (25) for contacting a tab (T) of a male terminal fitting (M). The contact (25) is pressed by the tab (T) so that the resilient contact piece (18) is deformed with the fold (20) as a supporting point and an extending end (26) thereof contacts the bottom wall (13). The resilient contact piece (18) has a front narrowed portion (29) between the fold (20) and the contact (25) and a rear narrowed portion 30 between the contact (25) and the extending end (26).

13 Claims, 7 Drawing Sheets

FEMALE TERMINAL FITTING

BACKGROUND OF THE INVENTION

1. Field of the Invention

The invention relates to a female terminal fitting with a resilient contact.

2. Description of the Related Art

A known female terminal fitting with a resilient contact is disclosed in U.S. Pat. No. 5,235,743 and is illustrated in FIG. 7 herein. With reference to FIG. 7, a female terminal fitting 1 is used with a male terminal fitting 2 that has a tab 3 at one end. The female terminal fitting 1 has a rectangular tubular main body 4 with a bottom wall 5. A resilient contact piece 6 is folded back into the tubular main body 4 and is formed into a triangular shape with a contact 7 at the vertex of the triangle. A base 8 projects forward from the bottom wall 5 and a U-shaped fold 9 extends between the base 8 and the resilient contact 6. The tab 3 of the male terminal fitting 2 can be inserted into the tubular main body 4 of the female terminal fitting 1. Thus, the tab 3 presses the contact 7 down and deforms the resilient contact piece 6 about the fold 9 as a deformation supporting point.

The terminal fittings 1, 2 can be miniaturized by reducing the width and length of the tab 3 of the male terminal fitting 2. However, the contact 7 of the resilient contact piece 6 of the female terminal fitting 1 must be moved forward to a position that conforms to the dimensions of the shorter tab 3. These dimensional changes of the resilient contact piece 6 necessarily reduce the distance between the contact 7 and the fold 9. Thus, the fold 9 cannot be deformed as easily and an insertion resistance of the tab 3 becomes larger.

The invention was developed in view of the above problem and an object thereof is to enable a resilient contact piece to be deformed easily.

SUMMARY OF THE INVENTION

The invention is a female terminal fitting with a base wall and a resilient contact piece that projects from a leading end of the base wall. The resilient contact piece has a contact for contacting a mating male terminal fitting. The mating male terminal fitting presses the contact and hence the resilient contact piece is deformed with a fold thereof as a support point. The resilient contact piece has at least one rigidity-lowering portion between the base of the resilient contact piece and the contact. The rigidity-lowering portion has a smaller cross-sectional area with respect to a direction at an angle to the longitudinal direction.

The resilient contact piece preferably is folded back and substantially faces the base wall.

Preferably, the resilient contact piece is supported only at one end.

The at least one rigidity-lowering portion may be provided along an area of the resilient contact piece that includes the fold.

The mating male terminal fitting contacts the contact of the resilient contact piece. Thus, the resilient contact piece deforms resiliently with the fold as a supporting point. The resilient contact piece has the rigidity-lowering portion with a smaller cross-sectional area. Accordingly the rigidity of the resilient contact piece is reduced, and the resilient contact piece can be deformed easily.

Miniaturized male and female terminal fittings require the contact of the female terminal fitting to be closer to the fold and, therefore, the resilient contact piece tends to be difficult to deform. The present invention is particularly suitable for such smaller female terminal fittings.

The rigidity-lowering portion preferably is spaced from the fold on the resilient contact piece. Thus, the concentration of stress on the fold during the resilient deformation of the resilient contact piece is alleviated.

The resilient contact piece is formed into a substantially triangular or pointed shape. More particularly, the resilient contact piece extends at an angle from the contact toward the side opposite from the fold and has an extending end that contacts the base wall as the resilient contact piece is deformed beyond a specified degree. The rigidity-lowering portion of the resilient contact piece is spaced from the fold and the contact. Additionally, an auxiliary rigidity-lowering portion may be provided on the resilient contact piece at a position spaced between the contact and the extending end. The auxiliary rigidity-lowering portion has a smaller cross-sectional area with respect to a direction at an angle to the longitudinal direction.

The mating male terminal fitting presses the contact and causes the resilient contact piece to deform with the fold as a support point. Sufficient deformation about the fold brings the extending end into contact with the base wall. The resilient contact piece then is deformed with the extending end as a support point. The auxiliary rigidity-lowering portion and the rigidity-lowering portion enable the resilient contact piece to be deformed easily despite an increased resilient force due to the contact of the extending end with the bottom wall.

The rigidity-lowering portion and the auxiliary rigidity-lowering portion are provided at the positions away from the fold and the contact. Thus, the concentration of stress on the fold and the contact during the resilient deformation of the resilient contact piece can be alleviated.

The auxiliary rigidity-lowering portion is spaced from the extending end. As a result, a sufficient width can be ensured for the extending end to contact the base wall. Thus, the resilient contact piece can be supported to incline about its longitudinal axis during the resilient deformation and a contact state with the mating male terminal fitting can be stabilized.

The rigidity-lowering portion preferably has one or more cut-away portions formed by cutting away opposite edges of the resilient contact piece. The cut-away portions preferably are formed in a portion of the resilient contact piece excluding the area of the contact.

The rigidity-lowering portion may comprise one or more narrowed portions formed at an edge of the projecting base.

The base wall preferably has at least one excessive deformation preventing portion to avoid an excessive deformation of the resilient contact piece.

The projecting base of the base wall preferably is separated from the adjacent wall(s) by means of at least one slit.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female terminal fitting according to a first embodiment of the invention is identified by the numeral 10 in FIGS. 1 to 4. The female terminal fitting 10 has opposite front and rear ends disposed respectively at the left and right sides of FIG. 1. The rear end is configured for connection with an end of a wire (not shown) and the front end is configured for mating with a mating terminal fitting M. Additionally, reference is made to FIG. 2 concerning the vertical direction.

Figure 1:
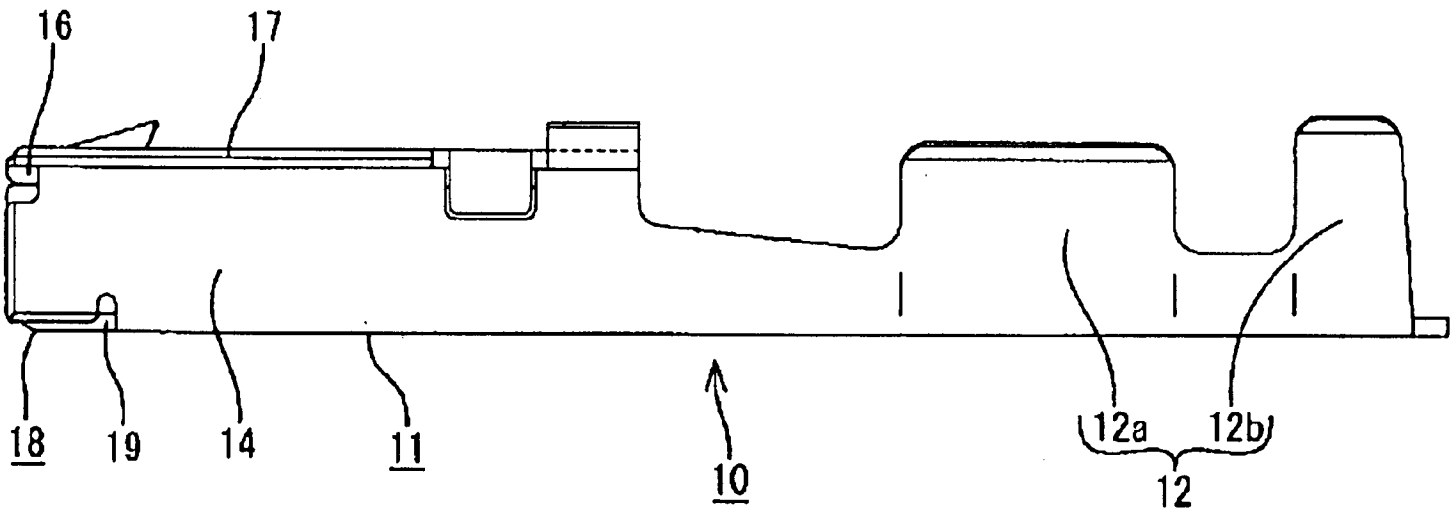
FIG. 1 is a side view of a female terminal fitting according to a first embodiment of the present invention.

The female terminal fitting 10 is formed into the shape shown in FIG. 1 by bending, embossing and/or folding a substantially flat blank obtained by stamping or cutting a conductive metallic plate. A substantially rectangular tubular main body 11 is formed at the front end of the female terminal fitting 10 and a resilient contact piece 18 is provided in the main body 11. The resilient contact piece 18 is configured for contact with a tab T of the male terminal fitting M inserted into the open front of the main body 11. A barrel 12 is provided at the rear end of the female terminal fitting 10 and has front and rear pairs of opposed crimping pieces 12*a*, 12*b*. The front crimping pieces 12*a* are configured to be crimped, bent or folded into connection with a core of a wire, whereas the rear crimping pieces 12*b* are configured to be crimped, bent or folded into connection with an insulated portion of the wire.

Figure 2:
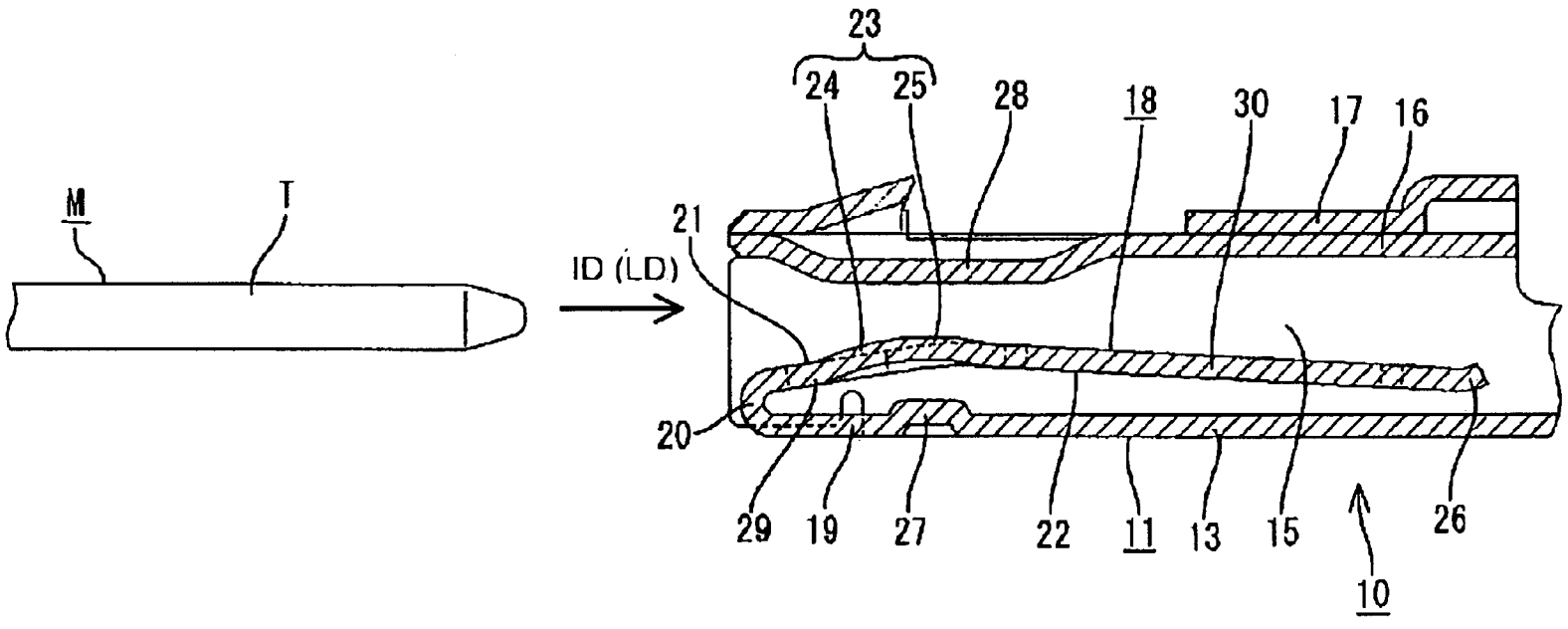
FIG. 2 is a fragmentary side sectional view of a male terminal fitting and the female terminal fitting.
Figure 3:
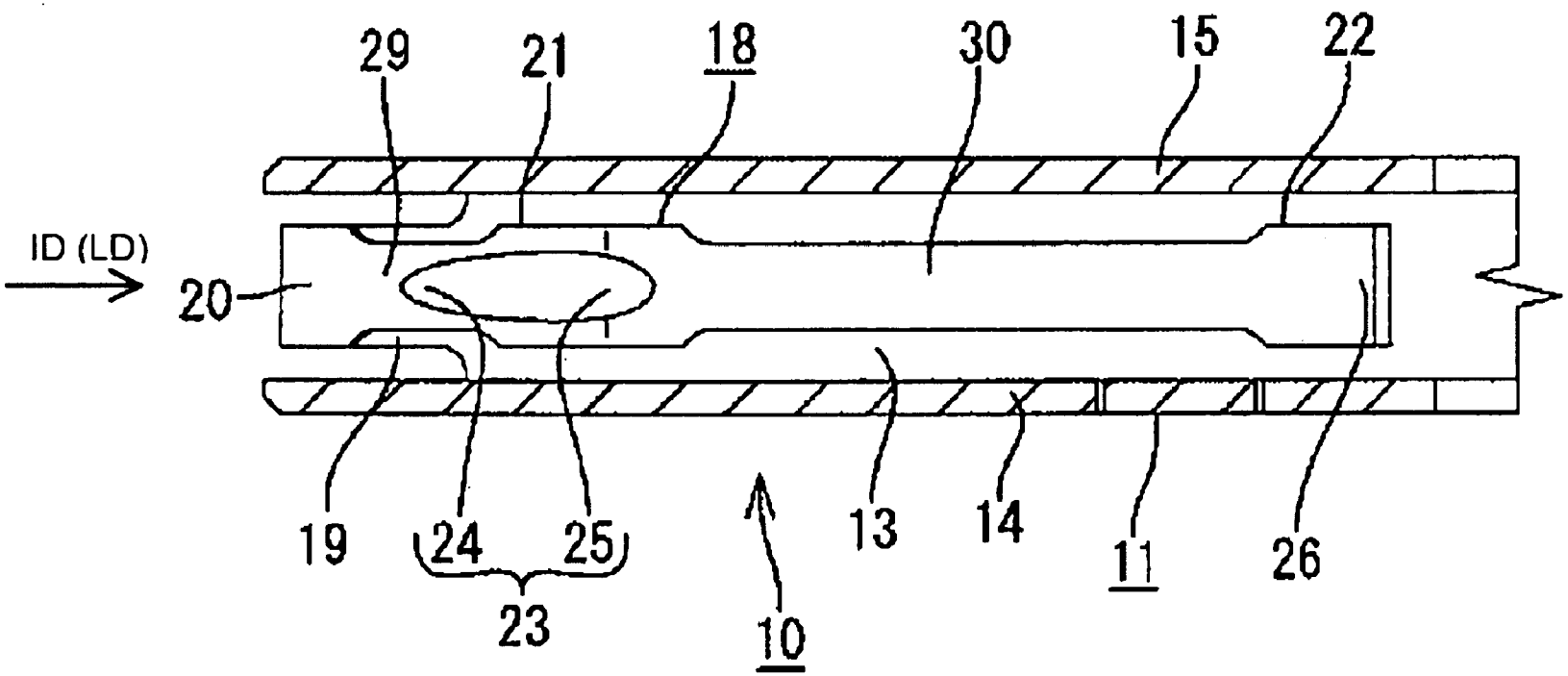
FIG. 3 is a fragmentary sectional plan view of the female terminal fitting.

The main body 11 is comprised of a narrow and long bottom wall 13 and side walls 14, 15 project substantially normal from the opposite side edges of the bottom wall 13. A ceiling wall 16 projects from the upper end of the side wall 14 to the side wall 15 and faces the bottom wall 13. An outer wall 17 projects from the upper end of the side wall 15 to the side wall 14 and is placed on or near the outer surface of the ceiling wall 16. As shown in FIGS. 2 and 3, the bottom wall 13 has its front end more backward than the other walls 14, 15, 16, 17.

A base 19 projects forward from the front end of the bottom wall 13 and is separated from the side walls 14, 15 by slits formed at the corners between the bottom wall 13 and the side walls 14, 15. A substantially U-shaped fold 20 is folded back from the front end of the base 19 and is accommodated in the main body 11. The resilient contact piece 18 is cantilevered rearwardly from the fold 20 and substantially faces the bottom wall 13. More specifically, the resilient contact piece 18 has a front slanted portion 21 that extends rearwardly from the fold 20 and a rear slanted portion 22 that extends rearwardly from the front slanted portion 21. Thus, the resilient contact piece 18 is formed into a substantially triangular or pointed shape. The inclination of the front slanted portion 21 relative to the bottom wall 13 is steeper than the inclination of the rear slanted portion 22 relative to the bottom wall 13. The rear slanted portion 22 is longer than the front slanted portion 21, and preferably about three times longer. The resilient contact piece 18 is resiliently deformable substantially along the vertical direction and the fold 20 is a deformation supporting point.

A long narrow elliptical bulge 23 is embossed to project up from an area of the resilient contact piece 18 that extends along a longitudinal direction LD from the front slanted portion 21 to the rear slanted portion 22. Specifically, the bulge 23 extends from a position more forward than the middle of the front slanted portion 21 to a position near the front end of the rear slanted portion 22. A guide 24 is defined on a portion of the bulge 23 that inclines up and to the back. The guide 24 is contacted slidably by the tab T and guides the deformation of the resilient contact piece 18. A contact 25 is defined behind the guide 24 at the vertex or apex of the resilient contact piece 18 and resiliently contacts the tab T that has been inserted to a proper depth into the main body 11. The contact 25 is more forward than the middle of the main body 11 by a specified distance in conformity with the length of the tab T to reach substantially the middle of the tab T during its insertion (see FIG. 4). An extending rear end 26 of the rear slanted portion 22 is spaced from the bottom wall 13 by a specified distance when the resilient contact piece 18 is in a natural state. The extending end 26 contacts the bottom wall 13 as the resilient contact piece 18 is deformed. Thus, the extending end 26 cooperates with the fold 20 to define a deformation supporting point of the resilient contact piece 18.

An excessive deformation preventing projection 27 is embossed to project up from the bottom wall 13 at a position facing the contact 25 from below. The resilient contact piece 18 engages the excessive deformation preventing projection 27 to prevent the resilient contact piece 18 from being deformed beyond its resiliency limit. A receiving portion 28 bulges down from the ceiling wall 16 toward the resilient contact piece 18 at a position along the longitudinal direction LD facing the bulge 23. Thus, the tab T of the male terminal fitting M can be held tightly between the receiving portion 28 and the resilient contact piece 18.

The resilient contact piece 18 has a front and rear narrowed portions 29 and 30, as shown in FIG. 3. The narrowed portions 29, 30 are formed by cutting off the opposite side edges of the resilient contact piece 18 by a specified width that preferably is slightly more than 1/10 of the entire width of the resilient contact piece 18. Accordingly, the resilient contact piece 18 has a cross-sectional area reduced along a direction substantially normal to the longitudinal direction LD at each of the two narrowed portions 29, 30 and has a lower stiffness or rigidity to be deformed easily at these locations. The opposite front and rear ends of the two narrowed portions 29, 30 are widened gradually.

The front narrowed portion 29 is on the front slanted portion 21 of the resilient contact piece 18 and is spaced from the fold 20 and the contact 25. Specifically, the front end of the front narrowed portion 29 is slightly backward from the fold 20 and slightly forward from the bulge 23. The rear end of the front narrowed portion 29 is slightly forward from the contact 25. Thus, the front narrowed portion 29 overlaps the guide 24 of the bulge 23 with respect to the longitudinal direction LD. On the other hand, the rear narrowed portion 30 is on the rear slanted portion 22 of the resilient contact piece 18 at locations spaced from the contact 25 and the extending end 26. Specifically, the front end of the rear narrowed portion 30 is slightly backward from the contact 25, and the rear end thereof is slightly forward from the extending end 26. The rear narrowed portion 30 is longer than the front narrowed portion 29, and preferably about four times the length of the front narrowed portion 29.

The tab T of the male terminal fitting M can be inserted into the main body 11 from the front along the inserting direction ID and enters between the receiving portion 28 and the resilient contact piece 18. The front end of the tab T is held in sliding contact with the forwardly inclined guide 24 of the bulge 23. Thus, the resilient contact piece 18 is guided through a resilient deformation as the tab T is inserted further.

Figure 4:
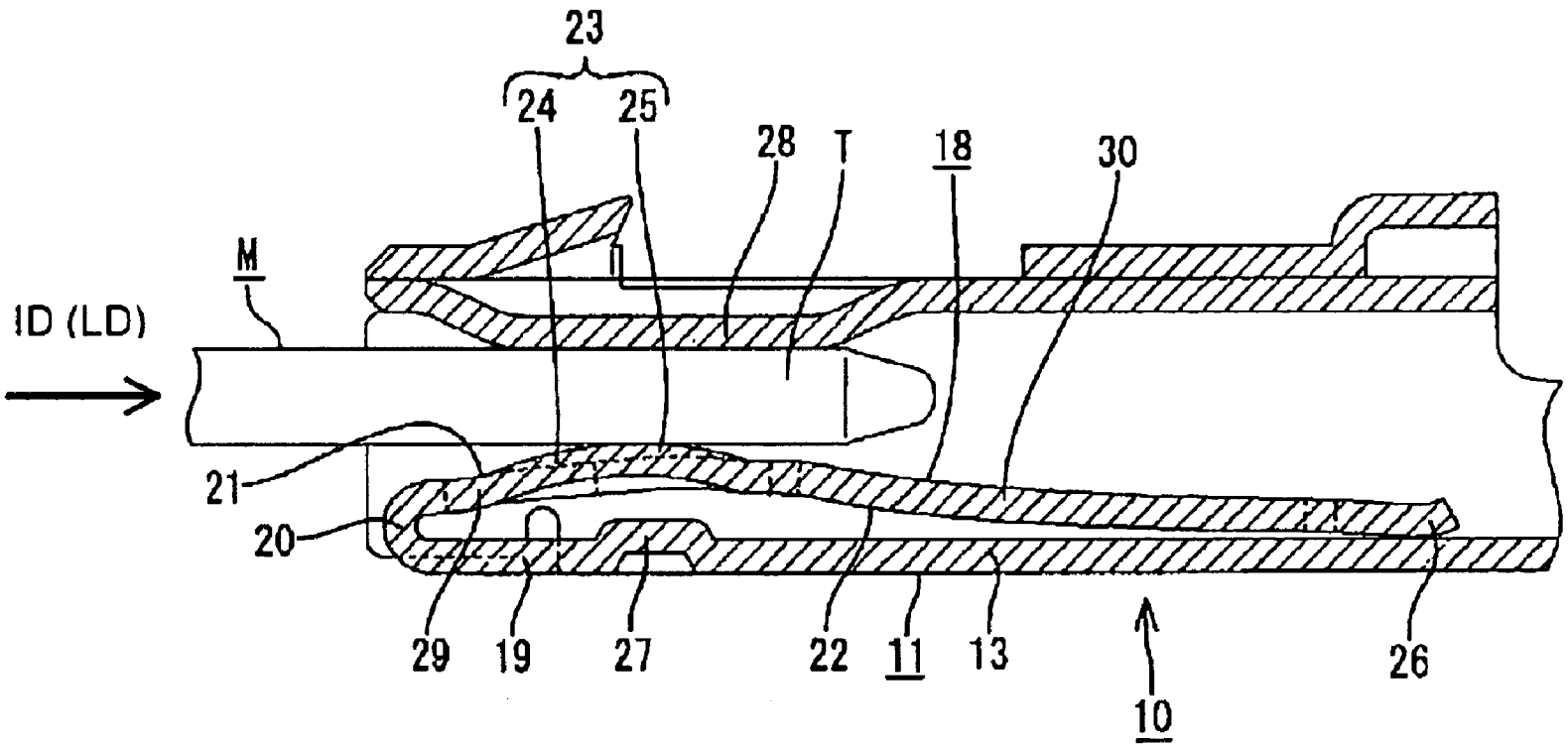
FIG. 4 is a fragmentary side sectional view showing a state where a tab is properly held in resilient contact with a resilient contact piece.

The tab T is held in sliding contact with the guide 24 until the tab T reaches the contact 25. Thus, the resilient contact piece 18 is deformed resiliently by a pressing force from the tab T, as shown in FIG. 4. At this time, the fold 20 is deformed to reduce its radius of curvature. Thus, the front slanted portion 21 and the rear slanted portion 22 including the contact 25 and the extending end portion 26 are displaced down and the extending end 26 contacts the bottom wall 13. In this process, the front narrowed portion 29 located between the fold 20 and the contact 25 is deformed slightly down into a substantially arcuate shape. The resilient contact piece 18 is easily resiliently deformable because the front narrowed portion 29 lowers the rigidity of the resilient contact piece 18, and the concentration of stress at the fold 20 is alleviated.

The contact 25 is displaced down after the extending end 26 contacts the bottom wall 13. As a result, a portion of the resilient contact piece 18 near the contact 25 is deformed so that the angle between the front and rear slanted portions 21 and 22 increases with the fold 20 and the extending end 26 functioning as deformation supporting points. In this process, the front and rear narrowed portions 29 and 30 spaced from the contact 25 are deformed down into substantially arcuate shapes. At this time, the extending end 26 is held in contact with the bottom wall 13 to support the resilient contact piece 18 and to increase the resilient force of the resilient contact piece 18. However, the front and rear narrowed portions 29 and 30 decrease the rigidity of the resilient contact piece 18, and hence the resilient contact piece 18 is easily resiliently deformable. Further, the two narrowed portions 29, 30 are spaced from the fold 20 and the contact 25. Thus, stress resulting from the resilient deformation is distributed over substantially the entire resilient contact piece 18 to alleviate the concentration of the stress at the fold 20 and the contact 25.

As described above, the tab T inserted into the main body 11 to a proper depth is held tightly between the receiving portion 28 and the resilient contact piece 18. At this time, the resilient contact piece 18 is supported by having the extending end 26 held in contact with the bottom wall 13 so as not to be inclined about its longitudinal axis. As a result, the resilient contact piece 18 is held stably in contact with the tab T.

The front narrowed portion 29 of the resilient contact piece 18 has a smaller cross-sectional area than other portions (e.g. the contact portion 25) of the contact piece 18. Thus, the rigidity of the resilient contact piece 18 can be made lower, and the resilient contact piece 18 can be deformed easily. Accordingly, a force required to deform the resilient contact piece 18 can be made smaller and the insertion resistance of the male terminal fitting M can be reduced. Further, the front and rear narrowed portions 29 and 30 enable the resilient contact piece 18 to be deformed easily despite an increased resilient force after the extending portion 26 contacts the bottom wall 13.

The female terminal fitting 10 will have to be made smaller to conform to the miniaturization of the mating male terminal fitting M. Thus, the contact 25 must be near the fold 20 and the resilient contact piece 18 tends to be more difficult to deform resiliently. This embodiment is particularly suitable for such a smaller female terminal fitting 10.

The two narrowed portions 29, 30 are spaced from the fold 20 and the contact 25. Thus, the concentration of the stress at the fold 20 and the contact 25 during deformation the resilient contact piece 18 is alleviated. As a result the resilient contact piece 18 is prevented from being damaged.

The rear narrowed portion 30 is spaced from the extending end 26, thereby ensuring a sufficient width of the extending end 26 for contacting the bottom wall 13. Thus, the resilient contact piece 18 can be supported so as not to incline about its longitudinal axis during resilient deformation, thereby being held stably in contact with the tab T of the male terminal fitting M.

Figure 5:
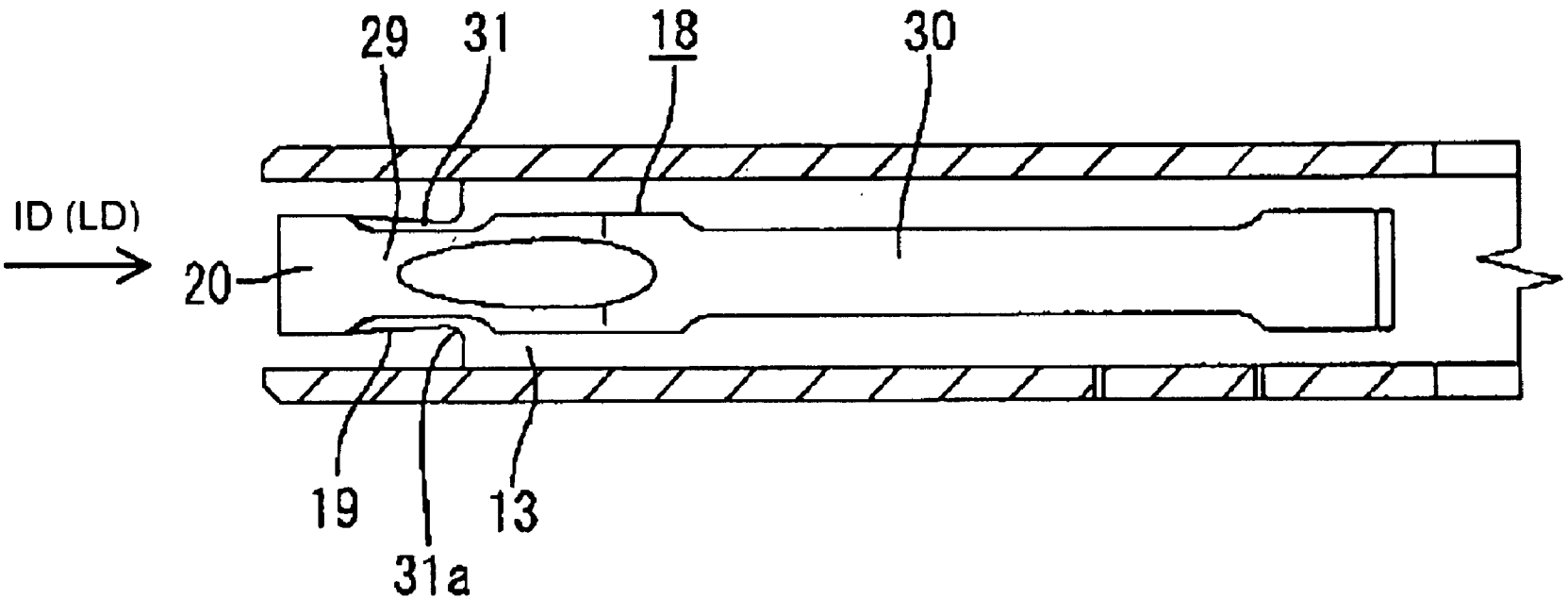
FIG. 5 is a fragmentary sectional plan view of a female terminal fitting according to a second embodiment of the present invention.

A second embodiment of the invention is described with reference to FIGS. 5 and 6. A resilient contact piece 18 of the second embodiment has a narrowed base 31 at a projecting base 19 of the resilient contact piece 18. The narrowed base 31 is formed by cutting off the opposite side edges of the projecting base 19 so that the width of the projecting base 19 gradually decreases toward the back of the terminal fitting 10. The front end of the narrowed base 31 is slightly back from the fold 20, and the rear end of the narrowed base 31 reaches a portion of the projecting base 19 coupled to the bottom wall 13.

Figure 6:
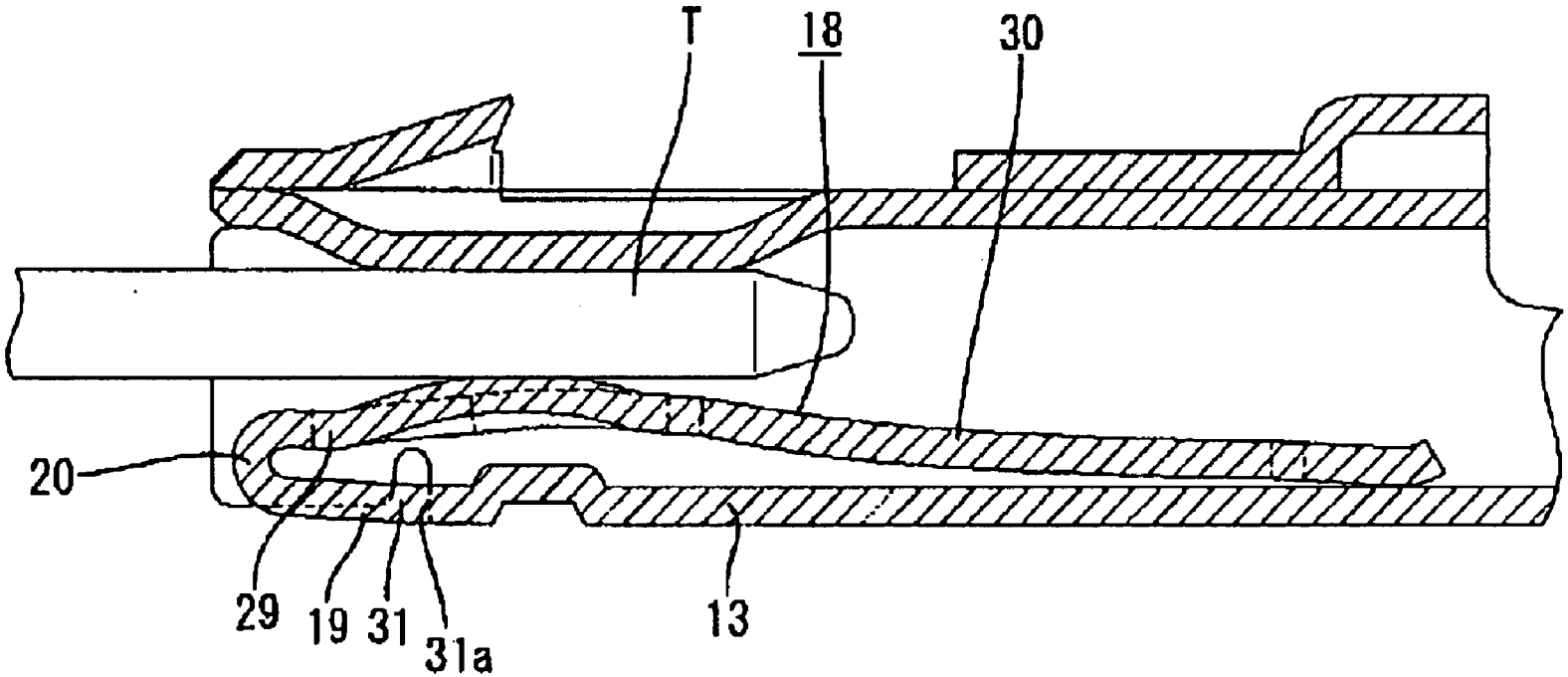
FIG. 6 is a fragmentary side sectional view showing a state where a tab is properly held in resilient contact with a resilient contact piece.
Figure 7:
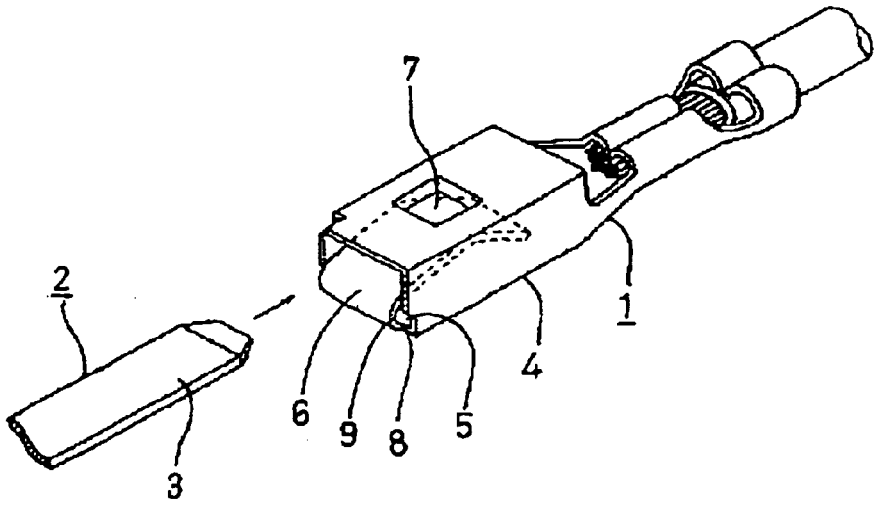
FIG. 7 PRIOR ART
FIG. 7 is a perspective view of a prior art female terminal fitting.

While being resiliently deformed by being pressed by a tab T, the resilient contact piece 18 is deformed resiliently by a tab T, as shown in FIG. 6, to incline back, and a rear end 31*a* of the narrowed base 31 having a smallest cross-sectional area defines a supporting point. In this way, the resilient contact piece 18 is deformable more easily by providing the narrowed base 31 in addition to the narrowed front portion 29 and the narrowed rear portion 30.

Other elements are similar to the first embodiment. These elements are denoted by the same reference numerals, but are not described again.

The invention is not limited to the above described and illustrated embodiments. For example, the following embodiments also are embraced by the technical scope of the invention as defined by the claims. Beside the following embodiments, various changes can be made without departing from the scope and spirit of the present invention as defined by the claims.

In the foregoing embodiments, the extending end of the resilient contact piece contacts the bottom wall during resilient deformation. However, the invention also is applicable to a resilient contact piece that resiliently deforms with only the fold as a support point without the extending end contacting the bottom wall.

The resilient contact piece of the first embodiment has front and rear narrowed portions. However, an embodiment without the rear narrowed portion of the first embodiment also is embraced by the invention. Further, the resilient contact piece of the second embodiment has the base end narrowed portion and the front and rear narrowed portions. However, the front and rear narrowed portions may be deleted from the second embodiment according to the invention.

In the foregoing embodiments, each narrowed portion is formed by cutting off opposite side edges of the resilient contact piece. However, the narrowed portion may be formed by cutting off only one side edge of the resilient contact piece. Further, a rigidity-lowering portion may have a smaller cross-sectional area, for example, by forming a hole in the resilient contact piece and/or by forming a recess in the resilient contact piece. Additionally or alternatively, the rigidity-lowering portion may have portions of reduced rigidity or stiffness provided by changes of the material itself, e.g. by means of heat-treatment, tempering, forging, irradiation, chemical and/or nuclear reactions, etc.

The front and rear narrowed portions are spaced from the fold, the contact and the extending end in the foregoing embodiments. However, they may be placed one over another in accordance with the present invention.

The female terminal fitting is connected with the wire by crimping in the foregoing embodiments. However, the invention is also applicable to a female terminal fitting connected with a wire by other means such as insulation displacement, soldering or the like.

What is claimed is:

1. A female terminal fitting, comprising:

a base wall having front and rear ends;

a projecting base projecting from the front end of the base wall;

a fold folded back from the projecting base; and a resilient contact piece projecting back along a longitudinal direction from the fold and being resiliently deformable with the fold as a support point, the resilient contact piece having a contact spaced rearwardly from the fold and disposed for contact with a mating male terminal fitting, at least one rigidity-lowering portion being provided on the resilient contact piece, the rigidity-lowering portion having a front end spaced rearwardly from the fold and a rear end substantially at the contact, the rigidity-lowering portion having a reduced cross-sectional area with respect to a direction at an angle to the longitudinal direction, the resilient contact piece further having an auxiliary rigidity-lowering portion rearward from the contact, the auxiliary rigidity-lowering portion having a reduced cross-sectional area with respect to an angle to the longitudinal direction, whereby the rigidity-lowering portion and the auxiliary rigidity-lowering portion provides low insertion resistance for the male terminal fitting without creating stress concentration at the fold.

2. The female terminal fitting of claim 1, wherein the resilient contact piece substantially faces the base wall.

3. The female terminal fitting of claim 1, wherein the resilient contact piece in an unbiased condition is supported only at one end.

4. The female terminal fitting of claim 1, wherein the resilient contact piece extends at an angle from the told to the contact such that portions of the resilient contact piece adjacent the contact are further from the base wall than portions of the resilient contact piece adjacent the fold and the resilient contact piece extends at an angle from the contact toward an end of the resilient contact opposite from the fold and has an extending end which contacts the base wail as the resilient contact piece is deformed beyond a specified degree.

5. The female terminal fitting of claim 1, wherein the auxiliary rigidity-lowering portion is spaced from both the contact and the extending end.

6. The female terminal fitting of claim 1, wherein the rigidity-lowering portion comprises cut-away portions formed by cutting away substantially opposite edges of the resilient contact piece.

7. The female terminal fitting of claim 6, wherein the cut-away portions are formed in portions of the resilient contact piece excluding the contact.

8. The female terminal fitting of claim 1, wherein the rigidity-lowering portion further comprises at least one narrowed portion formed at an edge of the projecting base.

9. The female terminal fitting of claim 1, wherein the base wall comprises at least one excessive deformation preventing portion for avoiding an excessive deformation of the resilient contact piece.

10. The female terminal fitting of claim 1, wherein the projecting base is at least partly separated from the adjacent wall(s) by at least one slit.

11. A female terminal fitting, comprising:

a base wall having opposite front and rear ends and defining a longitudinal direction extending between the ends;

a projecting base projecting from the front end of the base wall;

a fold folded back from the projecting base, the fold having a selected width extending transverse to the longitudinal direction of the base wail; and a resilient contact piece projecting back along a longitudinal direction from the fold and being resiliently deformable with the fold as a support point, the resilient contact piece having a contact spaced rearwardly from the fold and disposed for contact with a mating terminal fitting, at least one rigidity-lowering portion formed on the resilient contact piece between the fold and the contact, the rigidity-lowering portion having a width measured transverse to the longitudinal direction of the base wall that is less than the width defined by the fold, the resilient contact piece further having an auxiliary rigidity-lowering portion rearward from the contact, the auxiliary rigidity-lowering portion having a reduced cross-sectional area with respect to an angle to the longitudinal direction whereby the rigidity-lowering portion and the auxiliary rigidity-lowering portion facilitates deflection of the resilient contact piece for providing a low insertion resistance for the male terminal fitting without creating stress concentration at the fold.

12. The female terminal fitting of claim 11, wherein the resilient contact piece in an unbiased condition is supported only at one end.

13. The female terminal fitting of claim 12, wherein the resilient contact piece extends at an angle from the fold to the contact such that portions of the resilient contact piece adjacent the contact are further from the base wall than portions of the resilient contact piece adjacent the fold and the resilient contact piece extends at an angle from the contact toward an end of the resilient contact opposite from the fold and has an extending end which contacts the base wall as the resilient contact piece is deformed beyond a specified degree.

* * * * *